US008899935B2

(12) United States Patent
Buisson et al.

(10) Patent No.: US 8,899,935 B2
(45) Date of Patent: Dec. 2, 2014

(54) FAN ROTOR FOR AN AIRPLANE TURBOJET

(75) Inventors: Herve Buisson, Savigny le Temple (FR); Jean-Luc Goga, Champagne sur Seine (FR)

(73) Assignee: Snecma, Paris (FR)

( * ) Notice: Subject to any disclaimer, the term of this patent is extended or adjusted under 35 U.S.C. 154(b) by 632 days.

(21) Appl. No.: 13/318,502

(22) PCT Filed: Apr. 19, 2010

(86) PCT No.: PCT/FR2010/050747

§ 371 (c)(1),
(2), (4) Date: Nov. 2, 2011

(87) PCT Pub. No.: WO2010/128229

PCT Pub. Date: Nov. 11, 2010

(65) Prior Publication Data

US 2012/0045341 A1 Feb. 23, 2012

(30) Foreign Application Priority Data

May 6, 2009 (FR) ..... 09 53001

(51) Int. Cl.
*F01D 5/30* (2006.01)
*F04D 29/32* (2006.01)

(52) U.S. Cl.
CPC ..... *F04D 29/322* (2013.01); *F01D 5/3015* (2013.01)
USPC ..... 416/220 R

(58) Field of Classification Search
CPC ..... F01D 5/3015; F01D 5/3052; F01D 5/32; F01D 5/323; F01D 5/326; F04D 29/322; F04D 29/34
USPC ..... 416/220, 221, 248
See application file for complete search history.

(56) References Cited

U.S. PATENT DOCUMENTS

| | | | |
|---|---|---|---|
| 4,405,285 | A | 9/1983 | Surdi |
| 4,502,841 | A | 3/1985 | Kebedjis |
| 5,259,728 | A | 11/1993 | Szpunar et al. |
| 5,350,279 | A | 9/1994 | Prentice et al. |
| 7,824,157 | B2 | 11/2010 | Buisson et al. |
| 2009/0226321 | A1 | 9/2009 | Buisson et al. |

FOREIGN PATENT DOCUMENTS

| | | |
|---|---|---|
| EP | 0 061 948 | 10/1982 |
| EP | 1 748 154 | 1/2007 |
| FR | 2 535 793 | 5/1984 |

OTHER PUBLICATIONS

International Search Report Issued Jul. 28, 2010 in PCT/FR10/050747 Filed Apr. 19, 2010.

*Primary Examiner* — Edward Look
*Assistant Examiner* — Jesse Prager
(74) *Attorney, Agent, or Firm* — Oblon, Spivak, McClelland, Maier & Neustadt, L.L.P.

(57) ABSTRACT

A fan rotor for an airplane turbojet including locking blade roots in the respective grooves of an airplane turbojet fan rotor. Each blade root is housed in a groove that is closed by a main latch and by an additional latch that is distinct from the main latch and that is spaced apart therefrom by a predetermined distance.

6 Claims, 3 Drawing Sheets

FAN ROTOR FOR AN AIRPLANE TURBOJET

The invention relates to a fan rotor for an airplane turbojet, and it relates more particularly to locking blade roots in their respective grooves. The invention relates in particular to improving the system of individual latches that enable the blades to be held in their respective grooves. The invention also provides an airplane turbojet in which the fan is fitted with such a rotor.

In a bypass turbojet, the fan rotor carries a certain number of blades, each blade having a ribbed blade root that is engaged in a groove formed in the periphery of a wheel. The grooves are defined between radial projections that are provided with longitudinally extending lateral bulges covering the edges of the grooves and shaped to retain the blade roots.

On assembly, each blade root is engaged in its groove by causing it to slide through the upstream end thereof.

In the text below, the terms "upstream" and "downstream" are used respectively to designate a position towards the front or towards the rear of the engine, in the flow direction of air through the fan.

It is known to close each groove at its upstream end by a latch engaged in lateral notches formed on either side of the groove in upstream extensions of said radial projections and forming kinds of teeth projecting upstream from the wheel. These notches are oriented so as to converge towards each other on going radially outwards. The latches have lateral edges that present the same convergence as said notches. They are mounted by being engaged through the radially-inner open ends of the notches that are formed in said teeth.

The latches play an important role, since the axial force exerted by the blade roots on each of them normally lies in the range 500 kilograms (kg) to 900 kg. Furthermore, in the event of a failure, which may be as severe as a blade breaking off, the latch must be capable of dissipating the impact energy and of minimizing damage to the adjacent blades and parts.

Document U.S. Pat. No. 5,259,728 discloses a type of latch that includes a relatively thick metal element, e.g. made of titanium, and that carries on its downstream face a damper structure constituted by a hollow, honeycomb element. That structure is sufficiently rigid to withstand the normal forces from a blade root. In the event of a severe incident, it serves to damp the impact by being flattened.

Nevertheless, the honeycomb structure is made from relatively thin metal sheet and it is difficult to fasten (weld) to the downstream face of the thick metal element of said latch. The cost price of such a latch is also quite high.

The invention serves to solve those problems.

Document EP 0 061 948 describes a blade-locking device in which a latch referred to as a "main " latch is associated with an additional latch that is spaced apart therefrom.

More precisely, the invention provides a fan rotor comprising fan blades attached to the periphery of a wheel, each blade having a blade root engaged in a groove in said wheel and retained therein by a latch engaged in notches formed in the vicinity of and on either side of the upstream end of the corresponding groove in order to oppose movement of said blade root in an axial direction, each above-mentioned latch, referred to as a "main" latch, being associated with an additional latch that is distinct from said main latch, wherein the additional latch is spaced apart from the main latch at a predetermined distance, said additional latch being situated between said main latch and the upstream end of said blade root engaged in the groove.

In an embodiment, the additional latch is a thin wall. Said thin wall is advantageously made of a deformable material, e.g. such as a metal plate engaged in corresponding notches formed on either side of the groove at the upstream end thereof.

This metal plate of outline that is advantageously similar to that of the main latch may, for example, be made of stainless steel or of any other metal that can deform without breaking, becoming flattened against the downstream face of the main latch. The deformation of the thin plate does not lead to it being extracted, nor does it lead to debris being formed that might damage the adjacent blades.

The cost of said additional latch is very low. It is of thickness that is small compared with the thickness of the main latch, typically being about ¼ to ⅓ of the thickness of the main latch. Consequently, the corresponding notches formed on either side of the groove are likewise of small width and consequently they can be made easily by machining of the wire electroerosion type.

It is even possible to envisage adapting this new type of locking on existing wheels that are already in service, e.g. during a maintenance operation.

According to another advantageous characteristic, the additional latch includes a tongue that extends upstream substantially perpendicularly to its surface. This tongue is welded to an edge of said main latch. Consequently, on assembly, a single locking unit is put into place, with the spacing between the two latches being predetermined by the length of the tongue. This locking unit may be put into place by inserting both latches into their respective notches via the radially-inner open ends thereof.

According to another advantageous characteristic, a fastener tab projects upstream from said main latch for mounting a wedge that is inserted between the blade root and the bottom of said groove. Thus, the wedge, which is conventionally housed at the bottom of the groove, is also fastened to the main latch and is prevented from moving axially by the latch being put into place. Conversely, the wedge prevents the latch from being disengaged.

The invention can be better understood and other advantages thereof appear more clearly in the light of the following description given purely by way of example and made with reference to the accompanying drawings, in which.

Figure 1:
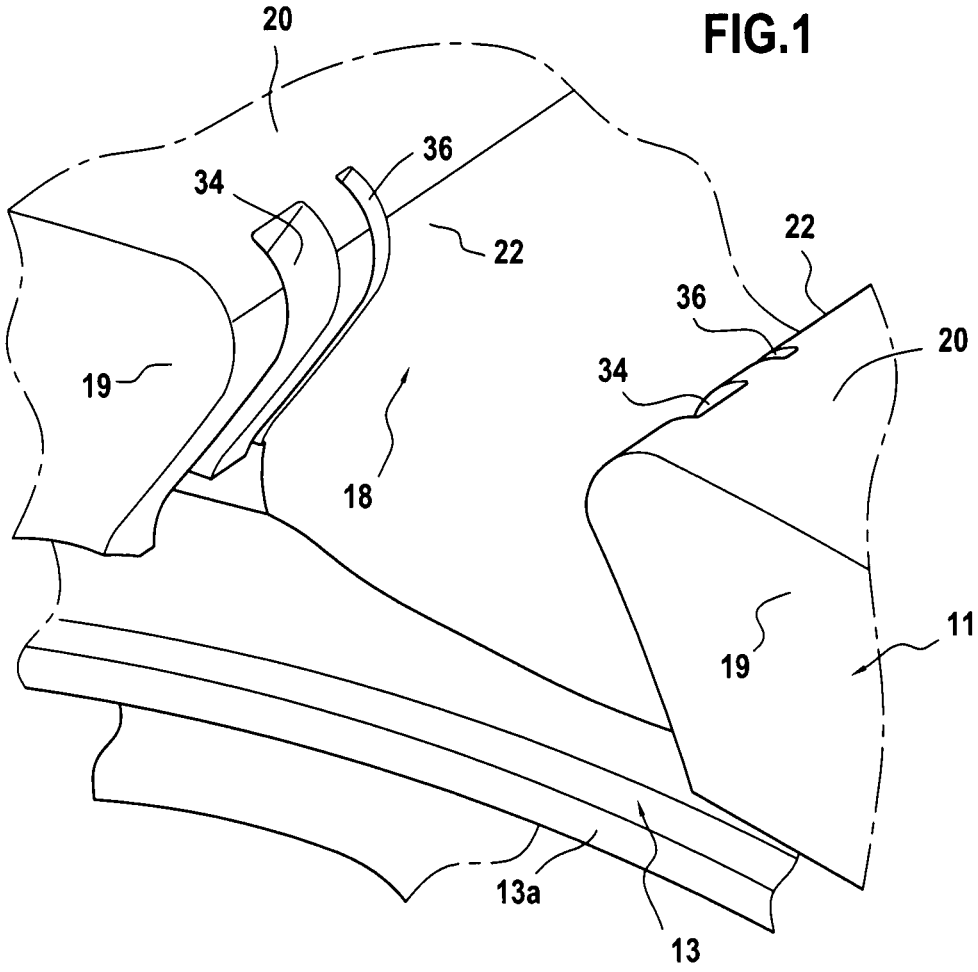
FIG. 1 is a fragmentary perspective view of the fan rotor wheel showing the end of a groove.
Figure 3:
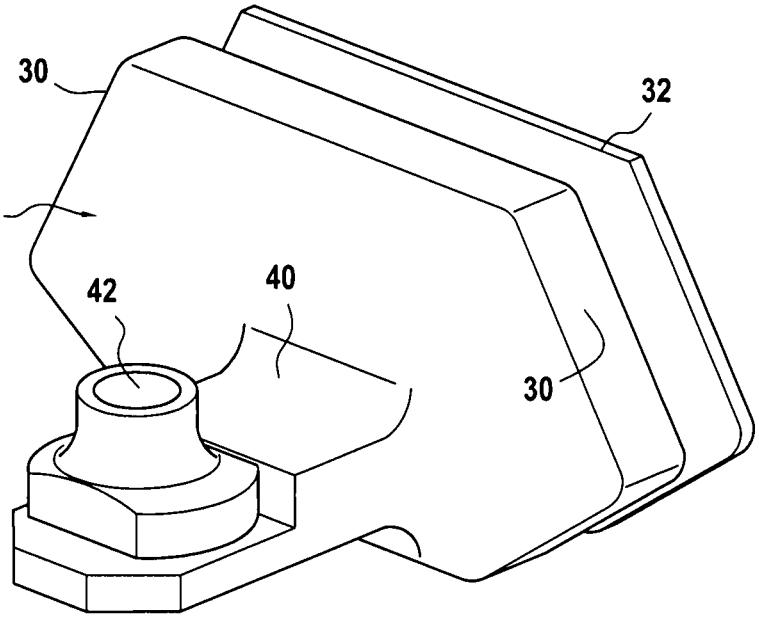
FIG. 3 is a perspective view of the same locking assembly.
Figure 2:
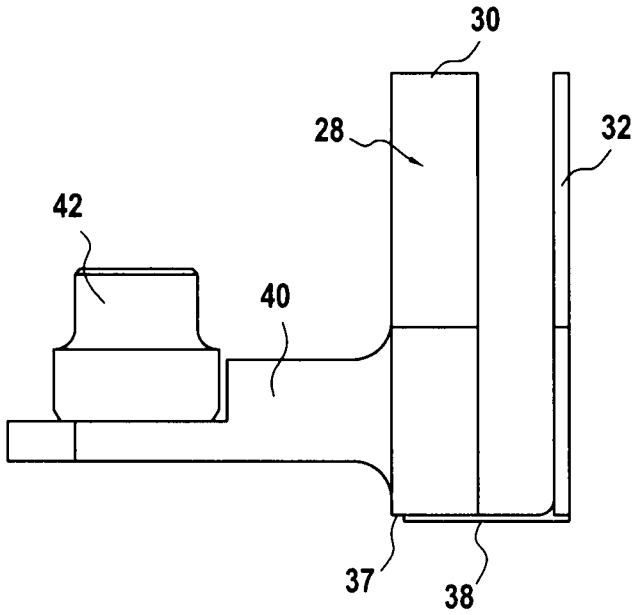
FIG. 2 is an elevation view of the locking assembly made up of two latches.
Figure 4:
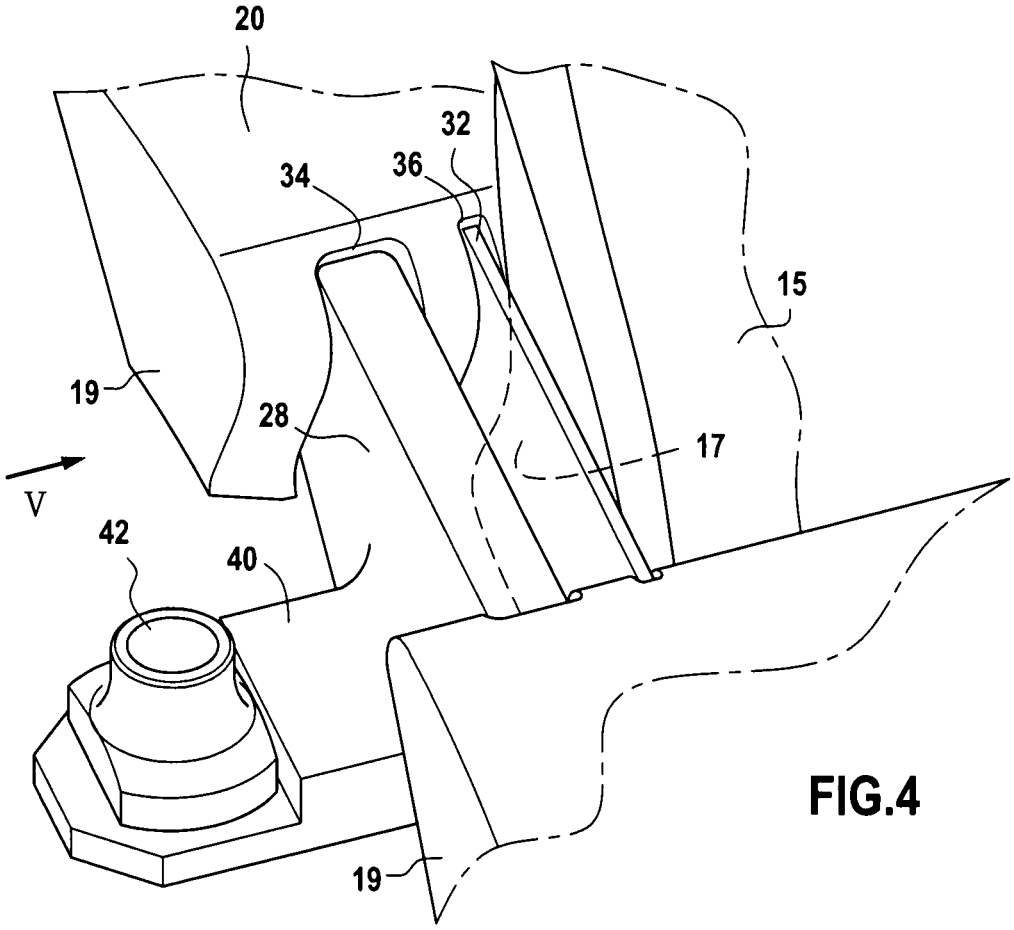
FIG. 4 is a fragmentary perspective view of the wheel, with the blade and the locking assembly in place.
Figure 5:
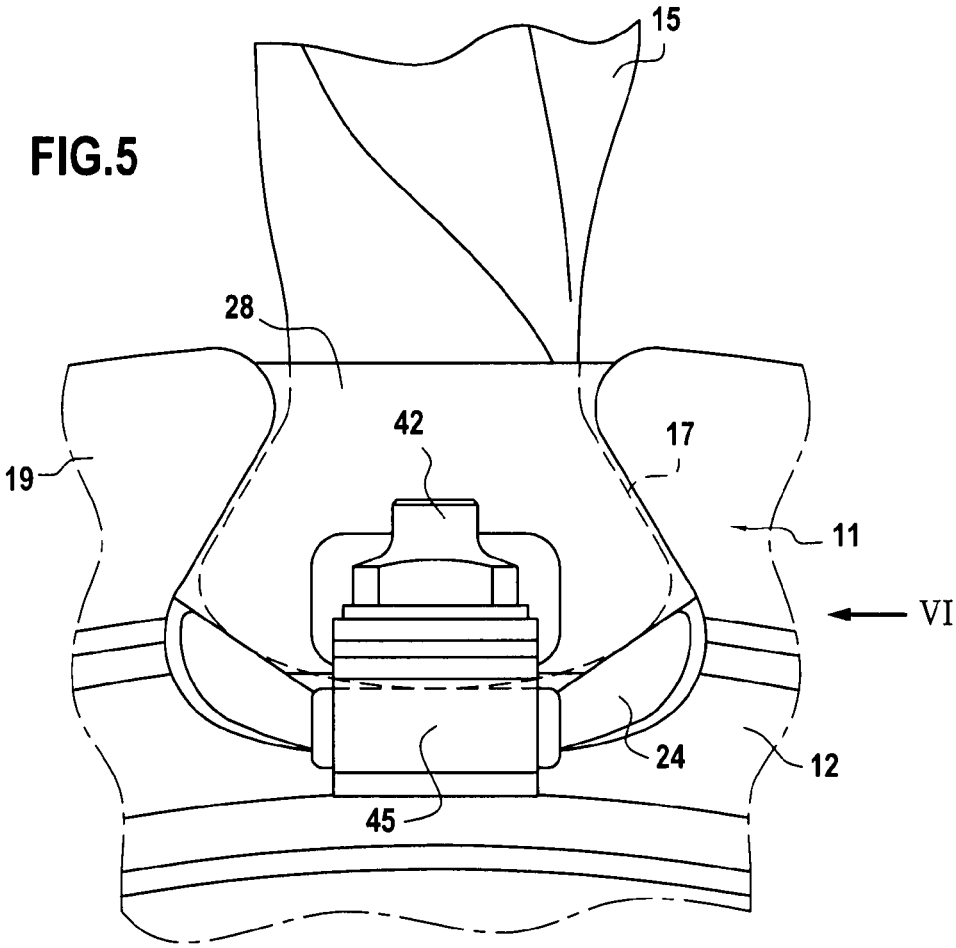
FIG. 5 is a fragmentary view looking along arrow V of FIG. 4, showing the locking assembly fastened to the wedge installed under the blade root.
Figure 6:
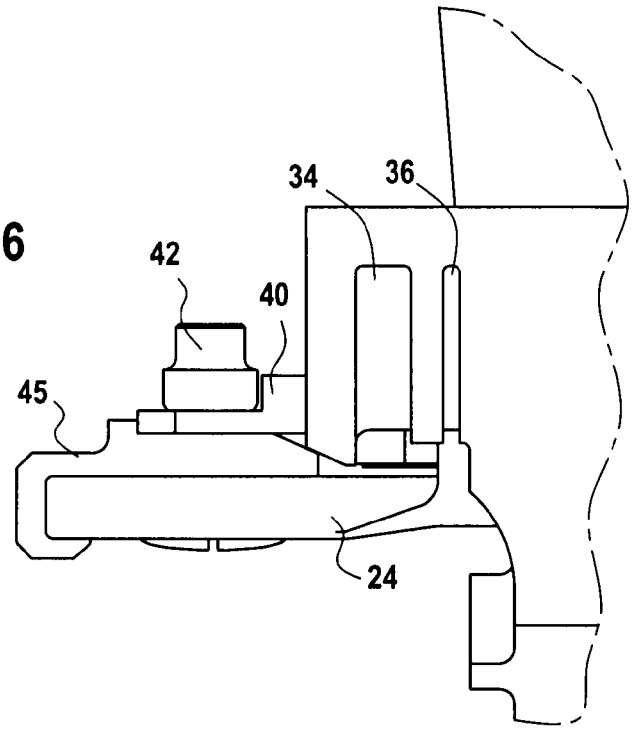
FIG. 6 is a view looking along arrow VI of FIG. 5.

The fan rotor 11 as shown mainly comprises a disk constituting a wheel 13 having fan blades 15 attached thereto. Each blade has a blade root 17 with lateral ribs engaged in a corresponding groove 18 in the wheel 13. The wheel thus has radial projections 20 at its periphery, each extending over a certain length parallel to the axis of the rotor. These radial projections are provided with lateral bulges 22 extending over the edges of the adjacent grooves 18. Thus, the shapes of the grooves 18 and of the projections 20 are determined so as to retain the blade roots. A longitudinal wedge 24 is inserted between the bottom of each groove and the blade root that is located therein in order to stabilize the radial position of the blade. The upstream ends of the grooves are closed individually by latches 28. A latch 28 is referred to below as a "main" latch.

Each main latch 28 is engaged in notches 34 formed on either side of the groove 18 that it closes in the vicinity of its upstream end. The end portions 19 of the radial projections 20 project upstream from the upstream face 13*a* of the wheel 13. Each notch 34 is formed in the projecting portion of the adjacent radial projection 20. Arranged in this way, the latch can oppose upstream movement of the blade in the axial direction.

The notches 34 open out in front of the groove and they are oriented so as to converge towards each other in a radially outward direction. A corresponding main latch 28 has edges 30 that converge in the same manner as the notches.

According to an important characteristic of the invention, each main latch 28 is associated with an additional latch 32 having a deformable thin wall that is distinct from the main latch 28 and that is spaced apart therefrom by a predetermined distance. The additional latch 32 is thus interposed between the main latch 28 and the upstream end of the blade root 17 mounted in the corresponding groove.

More precisely, the additional latch 32 is a plate of metal, e.g. stainless steel, that is engaged in corresponding notches 36 that are formed on either side of said groove in the projecting end portions 19 of the adjacent radial projections 20. Thus, the notches 34 of the main latch 28 and the notches of the additional latch 32 open out radially inwards in front of the upstream face 13*a* of the wheel 13. The additional latch 32 has substantially the same outline as the main latch 28 and the notches 36 in which it is engaged are also similar to those that receive the adjacent main latch. However they are of smaller axial length since the additional latch 32 is thinner than the main latch. Typically, the thickness of the additional latch lies approximately between one-fourth and one-third the thickness of the main latch.

As can be seen in the drawings, the additional latch includes a tongue 38 extending substantially perpendicularly to its surface towards the main latch, and the tongue is welded to an edge 37 of the main latch. This provides a one-piece locking assembly 28, 32 for closing the upstream end of each groove 18. This assembly is put into place by inserting both latches simultaneously into their notches, in a radially outward direction.

Furthermore, a fastener tab 40 projects upstream from the main latch to hold stationary the wedge 24 that is inserted between the blade root and the bottom of the groove. This fastener tab 40 is provided with a captive nut 42 and the end of the wedge is pierced by a hole. Thus, after the latches have been put into place, the wedge 24 is slid into the groove 18 between its bottom wall and the inner radial face of the blade root, and the end of the wedge is fastened to the fastener tab by means of a screw or the like. The screw passes through the hole in the wedge and is screwed into the nut in the latch. A spacer part 45 is interposed between the end of the wedge 24 and the fastener tab 40.

The notches 36 for the additional latch are narrow, and consequently they can be made by implementing a wire electroerosion method. This operation may be performed on an already-existing rotor wheel, i.e. a wheel that was not initially designed for this type of locking.

The invention claimed is:

1. A fan rotor comprising:

fan blades attached to a periphery of a wheel, each blade including a blade root engaged in a groove in the wheel and retained therein by a latch engaged in notches formed in a vicinity of and on either side of an upstream end of the corresponding groove to oppose movement of the blade root in an axial direction, each latch, as a main latch, being associated with an additional latch that is distinct from the main latch, wherein the additional latch is spaced apart from the main latch at a predetermined distance, the additional latch being situated between the main latch and an upstream end of the blade root engaged in the groove.

2. A fan rotor according to claim 1, wherein the additional latch is a thin wall engaged in corresponding notches formed in either side of the groove.

3. A fan rotor according to claim 2, wherein the thin wall is made of deformable material.

4. A fan rotor according to claim 1, wherein the additional latch is essentially constituted by a metal plate.

5. A fan rotor according to claim 1, wherein the additional latch includes a tongue extending upstream substantially perpendicularly to its surface and welded to an edge of the main latch.

6. A fan rotor according to claim 1, wherein a fastener tab projects upstream from the main latch for mounting a wedge inserted between the blade root and the bottom of the groove.

* * * * *